US012060204B2

(12) United States Patent
Gedanke et al.

(10) Patent No.: US 12,060,204 B2
(45) Date of Patent: Aug. 13, 2024

(54) CONTAINER FOR HOLDING AND DISPENSING GRANULAR PRODUCTS

(71) Applicant: Church & Dwight Co. Inc., Princeton, NJ (US)

(72) Inventors: Sergio Gedanke, Brooklyn, NY (US); Akbar Ansari, Cockeysville, MD (US); Rhys Weinberger, Hillsborough, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 130 days.

(21) Appl. No.: 17/699,503

(22) Filed: Mar. 21, 2022

(65) Prior Publication Data

US 2022/0297880 A1 Sep. 22, 2022

Related U.S. Application Data

(60) Provisional application No. 63/164,173, filed on Mar. 22, 2021.

(51) Int. Cl.

| | |
|---|---|
| ***B65D 5/70*** | (2006.01) |
| ***B65D 5/46*** | (2006.01) |
| ***B65D 5/468*** | (2006.01) |
| ***B65D 5/486*** | (2006.01) |
| ***B65D 5/72*** | (2006.01) |
| ***B65D 5/74*** | (2006.01) |
| *B65D 5/42* | (2006.01) |

(52) U.S. Cl.

CPC ..... *B65D 5/705* (2013.01); *B65D 5/4608* (2013.01); *B65D 5/46088* (2013.01); *B65D 5/724* (2013.01); *B65D 5/74* (2013.01); *B65D 5/4208* (2013.01)

(58) Field of Classification Search

CPC ..... B65D 5/703; B65D 5/705; B65D 5/723; B65D 5/724; B65D 5/74; B65D 5/46016; B65D 5/46088; B65D 5/5405; B65D 5/542; B65D 5/4608; B65D 77/065

USPC ..... 229/215, 122.32, 125.15, 219; 220/770; 222/540, 572

See application file for complete search history.

(56) References Cited

U.S. PATENT DOCUMENTS

| | | | | | |
|---|---|---|---|---|---|
| D183,567 | S | * | 9/1958 | Hagan | D9/432 |
| 4,313,556 | A | * | 2/1982 | Boyle | B65D 5/029 229/110 |
| 5,114,013 | A | * | 5/1992 | Brown | B65D 5/705 229/221 |
| 5,332,146 | A | * | 7/1994 | Brauner | B65D 5/029 D9/414 |

(Continued)

FOREIGN PATENT DOCUMENTS

| | | | | | |
|---|---|---|---|---|---|
| AR | 085680 | A4 | | 10/2013 | |
| DE | 3704540 | A | * | 8/1988 | B65D 5/701 |

(Continued)

*Primary Examiner* — Nathan J Newhouse
*Assistant Examiner* — Phillip D Schmidt
(74) *Attorney, Agent, or Firm* — Church & Dwight Co., Inc.

(57) ABSTRACT

A container for holding and dispensing a granular product is disclosed, where the container includes handling and opening structures that are ergonomically designed to make carrying and dispensing the product easier and more convenient for a user.

22 Claims, 9 Drawing Sheets

(56) References Cited

U.S. PATENT DOCUMENTS

| | | | | |
|---|---|---|---|---|
| 5,518,174 | A * | 5/1996 | Botterman | B65D 5/4604 229/207 |
| 6,045,036 | A | 4/2000 | Ring | |
| 6,116,502 | A * | 9/2000 | Noseworthy | B65D 5/705 229/215 |
| D521,373 | S | 5/2006 | Stanton | |
| D521,376 | S | 5/2006 | Mosto | |
| 7,097,093 | B2 | 8/2006 | Darin et al. | |
| 7,523,853 | B2 | 4/2009 | Kortsmit et al. | |
| D596,027 | S | 7/2009 | Kalberer | |
| 7,581,673 | B2 | 9/2009 | Elliston | |
| 8,622,240 | B2 * | 1/2014 | Krasucki | B65D 5/725 229/218 |
| 8,950,657 | B2 | 2/2015 | Wagner | |
| D860,782 | S | 9/2019 | Luik | |
| 2010/0102112 | A1 * | 4/2010 | Ouillette | B65D 5/606 493/162 |
| 2012/0074159 | A1 * | 3/2012 | Krasucki | B65D 5/725 220/837 |
| 2012/0104079 | A1 * | 5/2012 | Wagner | B65D 5/46024 493/84 |
| 2019/0210860 | A1 | 7/2019 | Bourke | |

FOREIGN PATENT DOCUMENTS

| | | | | |
|---|---|---|---|---|
| GB | 2045723 | A | 11/1980 | |
| GB | 2413549 | A * | 11/2005 | B65D 5/705 |

* cited by examiner

CONTAINER FOR HOLDING AND DISPENSING GRANULAR PRODUCTS

CROSS-REFERENCE TO RELATED APPLICATIONS

This application claims priority to and the benefit of U.S. Provisional Application No. 63/164,173, filed Mar. 22, 2021, which is hereby incorporated by reference herein in its entirety.

FIELD OF THE DISCLOSURE

The present disclosure relates to a container for holding and dispensing granular products, such as cat litter or detergent. More particularly, the present disclosure relates to improved containers that are more ergonomically designed and convenient to use.

BACKGROUND

Containers for holding and dispensing granular, powdered, or otherwise flowable materials are fairly well-known. These containers typically include some type of opening and a handle for carrying and pouring the contents. The handles are typically arranged on the container for aesthetic purposes or manufacturing convenience, but may be difficult or uncomfortable to use. In addition, the handles are frequently plastic straps that are secured to the container via structure that extends through the walls of the container, which may require additional manufacturing processes and/or may complicate recycling the container after use.

Accordingly, there exists a need for a container having a handle assembly and opening structure that lessens or eliminates at least the drawbacks mentioned herein.

BRIEF SUMMARY OF THE DISCLOSURE

The present disclosure relates to containers for holding and dispensing materials that are granular and flowable in form and are formed via a plurality of foldable panels. The containers include ergonomically designed handling structures that are more comfortable and easier for a user, especially when dispensing the product. The containers include further features as described below to make the containers overall easier to use.

In one aspect, the container includes a plurality of panels that at least partially define an interior of the container when in an assembled configuration. The plurality of panels includes a front panel, a back panel, a first side panel, a second side panel, a top panel and a bottom panel, where each of the panels comprises a base layer and an exterior layer. The container further includes a handle extending from the top panel and oriented to extend across a width of the top panel from proximate the first side panel to proximate the second side panel, a hand grip disposed in the exterior layer of the bottom panel and disposed proximate the back panel, the hand grip oriented substantially parallel to the handle, and an opening structure disposed in the front panel and having a door defined by a line of weakness extending through the front panel and configured to be breakable when a gripping tab coupled to the door is moved from a first position to a second position thereby providing access to the interior of the container via an opening defined by the front panel.

Furthermore, the panels are hingedly coupled to one another to allow the panels to fold relative to one another in one or both directions via fold lines created by stamping, indenting, pre-creasing, scoring, a series of perforations, or any combination thereof. The panels are folded at approximately 90 degrees relative to adjacent panels in the assembled configuration. In some implementations, the exterior layer is configured to have indicia, such as, for example, an ornamental design, identifying information, or a date code disposed (e.g., printed) thereon.

In various implementations, the container further includes a flap disposed in the top panel proximate the front panel and defining a receptacle configured to receive and removably secure at least a portion of the gripping tab. The door of the opening structure may be hingedly coupled to the top panel. The container may also include visual or physical indicia for providing a cue to a user of the pour configuration of the container, such as, for example, a curved profile fold disposed in one corner of the box that a user can see and/or feel. In some implementations, the curved profile is disposed between the back panel and the second side panel.

Additionally, the hand grip feature may include at least two parallel slots extending through at least the exterior layer (or an outer panel depending on the structure) of the bottom panel. The slots or similar shapes are sized, shaped, and spaced to provide multiple grip sizes to accommodate different consumers. The parallel slots are oriented so as to be parallel with the handle. In various implementations, the handle is bonded to the base layer (or an inner panel depending on the structure) of the top panel and is configured to extend through an opening in the exterior layer (or an outer panel depending on the structure) of the top panel for gripping and to be collapsible so as to sit approximately flush with the exterior layer when not in use. The plurality of panels and handle may be made of a recyclable material (e.g., paperboard, corrugated board, chipboard, fiberboard, thermoplastic, paper film laminations, or combinations thereof), so as to be completely recyclable as a unit.

In further implementations, the container opening structure includes a locking structure for maintaining the opening structure in a closed orientation after the door has been opened. The locking structure may include an edge defined by the opening in the front panel and an exposed portion of the base layer of the front panel. The opening is configured to receive the gripping tab and the exposed portion of the base layer (or an inner panel depending on the structure) is configured to retain at least a portion of the gripping tab within the container.

In certain implementations, the plurality of panels is embodied in a blank having a first surface defined by the base layer and a second surface defined by the exterior layer. The blank includes a front panel made up of an inner front panel and an outer front panel, where the outer front panel is configured to overlap the inner front panel in the assembled configuration, a first side panel extending from a lateral side of the inner front panel, a back panel extending from a lateral side of the first side panel, a second side panel extending from a lateral side of the back panel, and the outer front panel extends from a lateral side of the second side panel via a second lateral side of the outer front panel. The blank further includes a top panel assembly and a bottom panel assembly. The top panel assembly has an inner top panel extending from a first longitudinal end of the first side panel and an outer top panel extending from a first longitudinal end of the second side panel. The outer top panel is configured to overlap the inner top panel in the assembled configuration. The bottom panel assembly has an inner bottom panel extending from a second longitudinal end of the first side panel and an outer bottom panel extending from a second longitudinal end of the second side panel. The outer bottom panel is configured to overlap the inner bottom panel in the assembled configuration. The overlapping panels may be secured in place via an adhesive in the assembled configuration.

Further, the blank may include a series of flaps extending from the various panels that may be folded into the container during assembly to block any gaps that may be defined between any of the panels. For example, the blank may include a first back flap extending from the first longitudinal end of the back panel and a second back flap extending from the second longitudinal end of the back panel and a first front flap extending from the first longitudinal end of the outer front panel and a second front flap extending from the second longitudinal end of the outer front panel. Additionally, the inner front panel of the blank may include a tab extending from the second longitudinal end thereof and configured to be folded under the inner bottom panel in the assembled configuration. A portion of the first lateral side of the back panel and a portion of the second lateral side of the second side panel may have corresponding curved profile fold lines to define the aforementioned indicia.

Furthermore, in the assembled configuration, the first surface of the outer back panel is adhered to the second surface of the inner back panel, the first surface of the outer top panel is adhered to the second surface of the inner top panel, and the first surface of the outer bottom panel is adhered to the second surface of the inner bottom panel. The outer top panel may include an opening die cut therethrough to define a receptacle between the outer top panel and the inner top panel that is configured to receive and removably secure at least a portion of the gripping tab. The outer top panel may also include an elongate opening die cut therethrough in a central location thereof and oriented across a width of the outer top panel. The elongate opening is configured to expose the exterior layer of the inner top panel and provide clearance for the handle. The handle may be bonded to the exterior layer of the inner top panel and a reinforcement panel may be coupled to the second surface of the inner top panel at a location thereof generally corresponding to a location of a handle assembly. The hand grip may be made up of at least two parallel slots die cut through the outer bottom panel and disposed proximate the back panel.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure or recited in any one or more of the claims, regardless of whether such features or elements are expressly combined or otherwise recited in a specific aspect description or claim herein. This disclosure is intended to be read holistically such that any separable features or elements of the disclosure, in any of its aspects, should be viewed as intended to be combinable, unless the context of the disclosure clearly dictates otherwise.

BRIEF DESCRIPTION OF THE DRAWINGS

Figure 1:
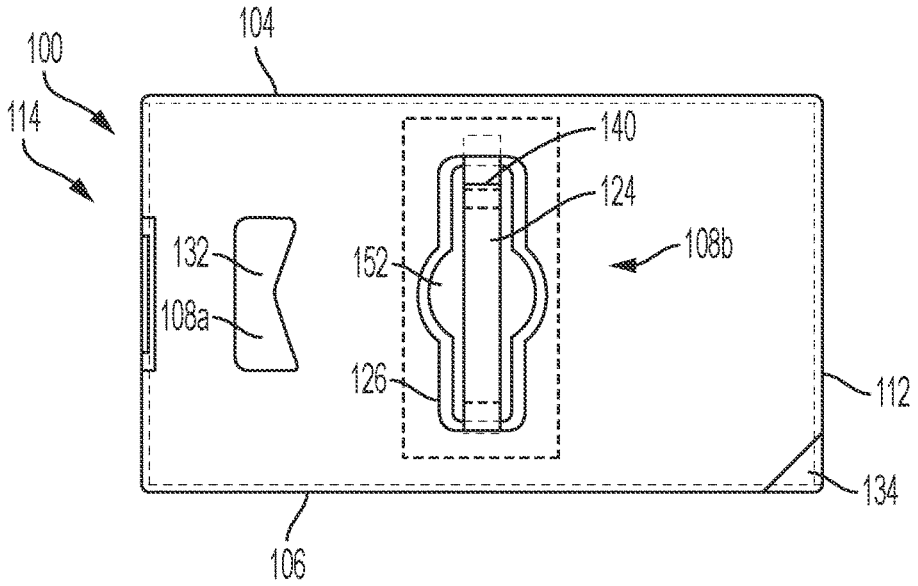
Figure 2:
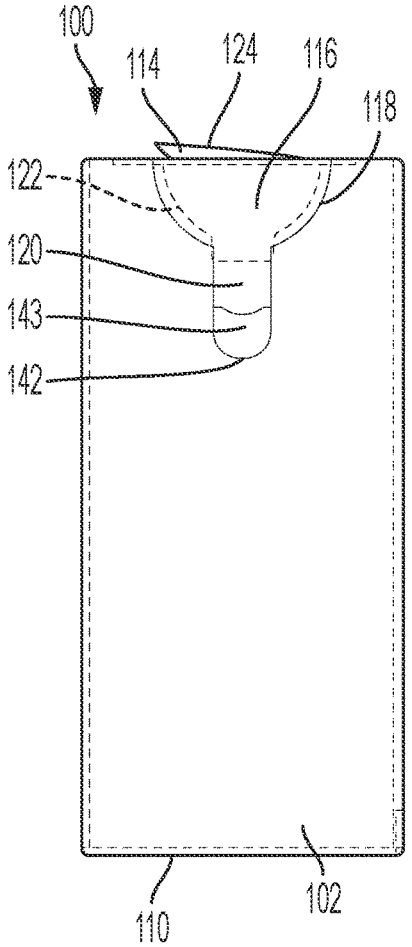
Figure 3:
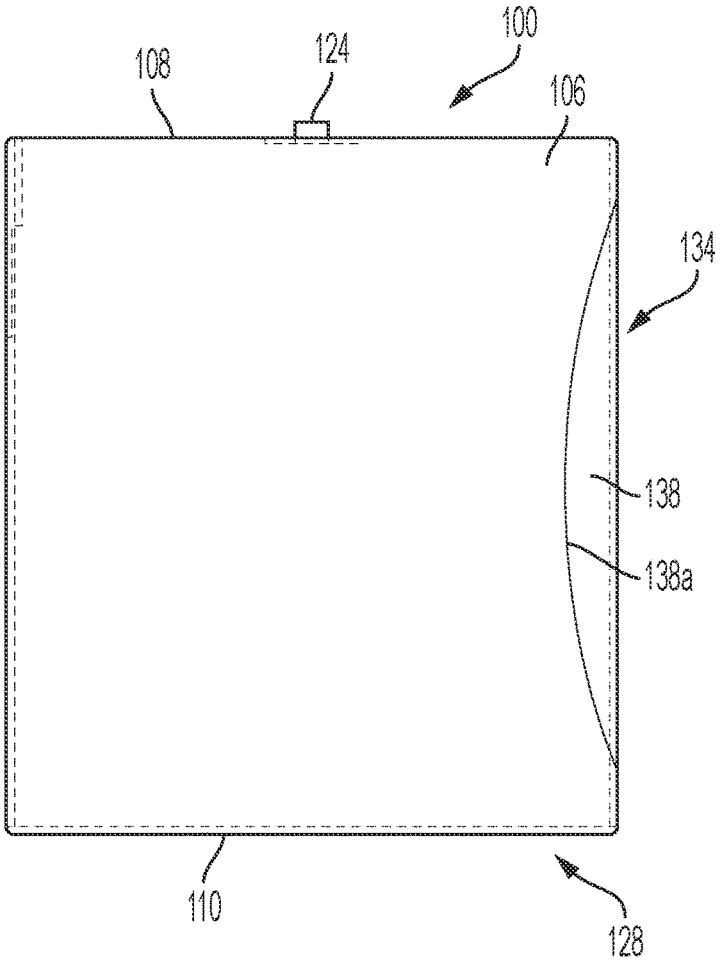
Figure 4:
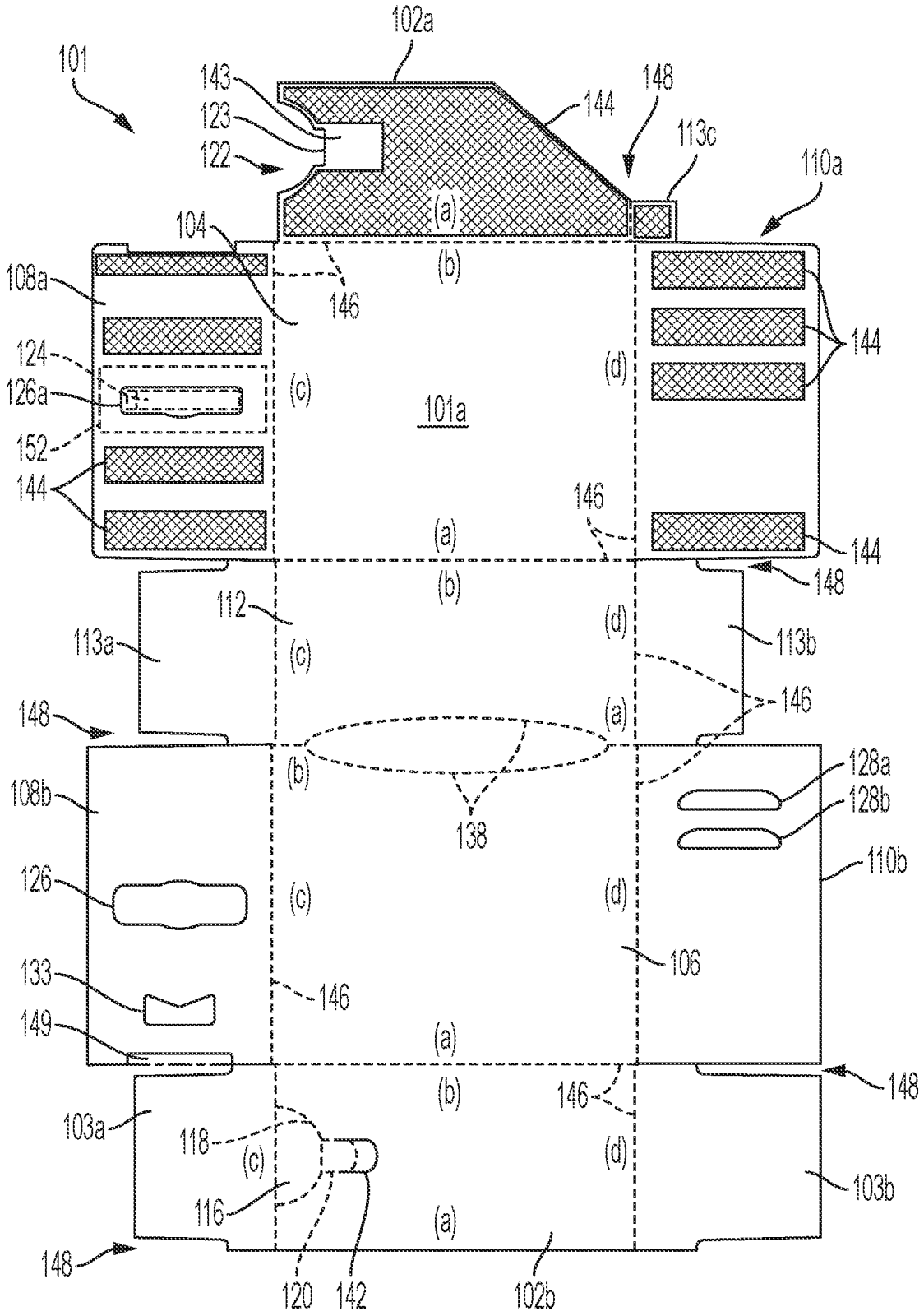
Figure 5:
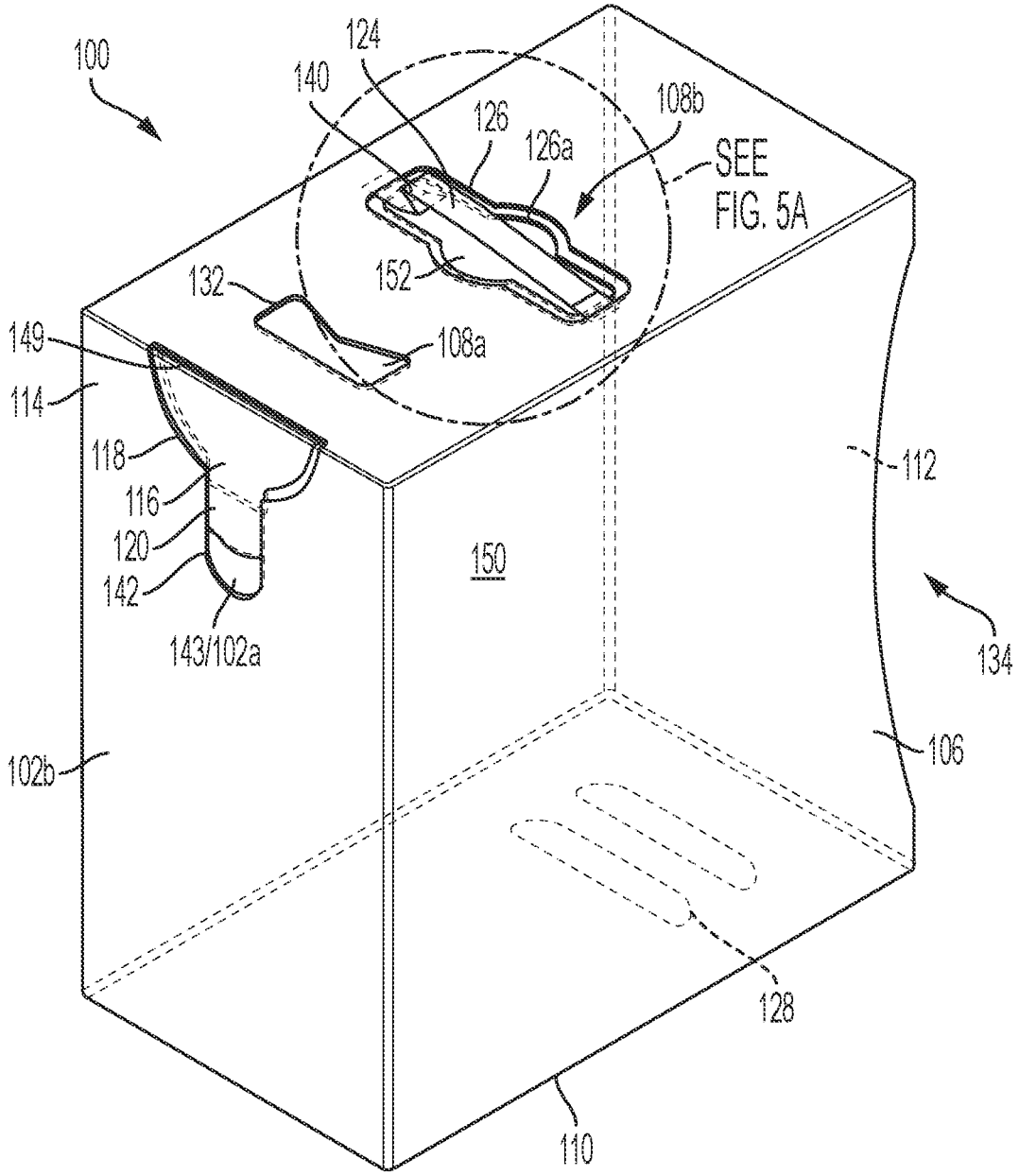
Figure 5A:
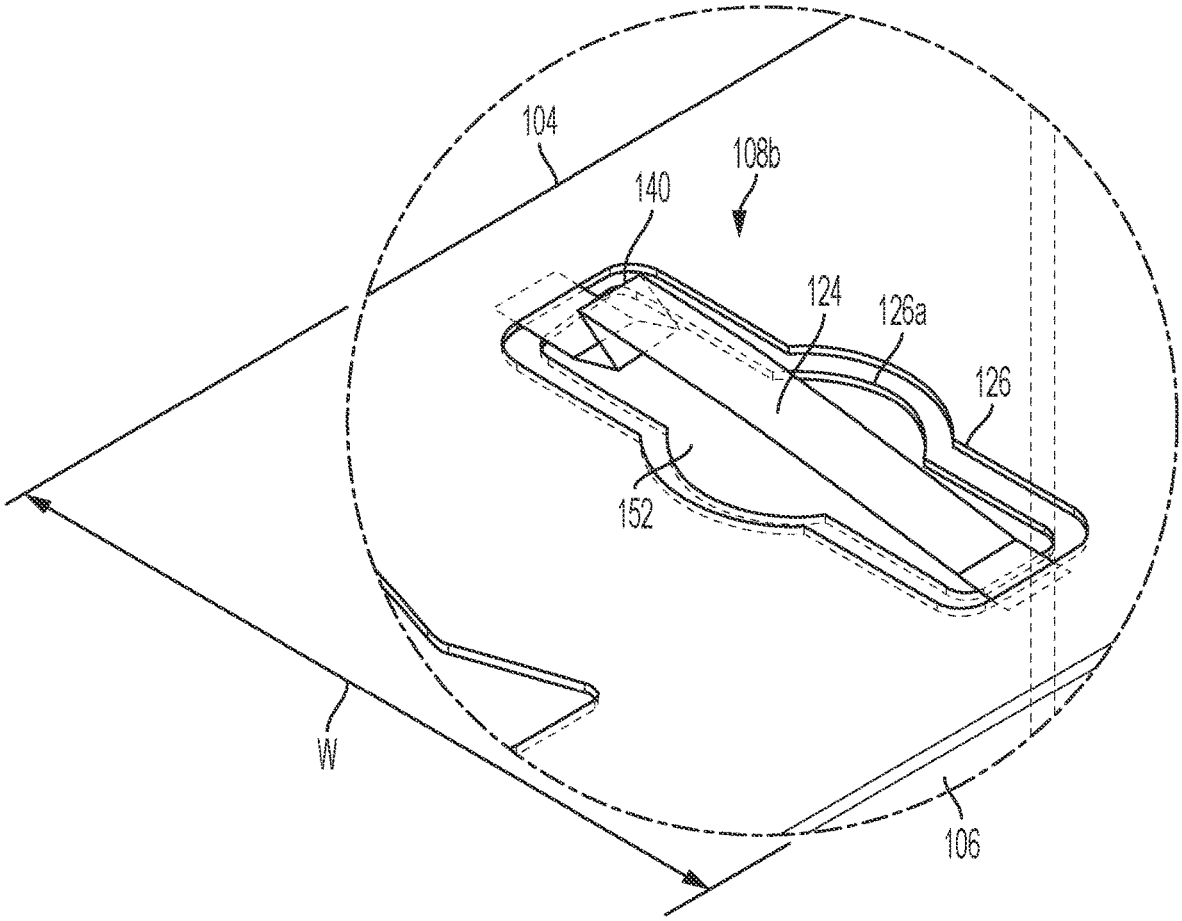
Figure 6:
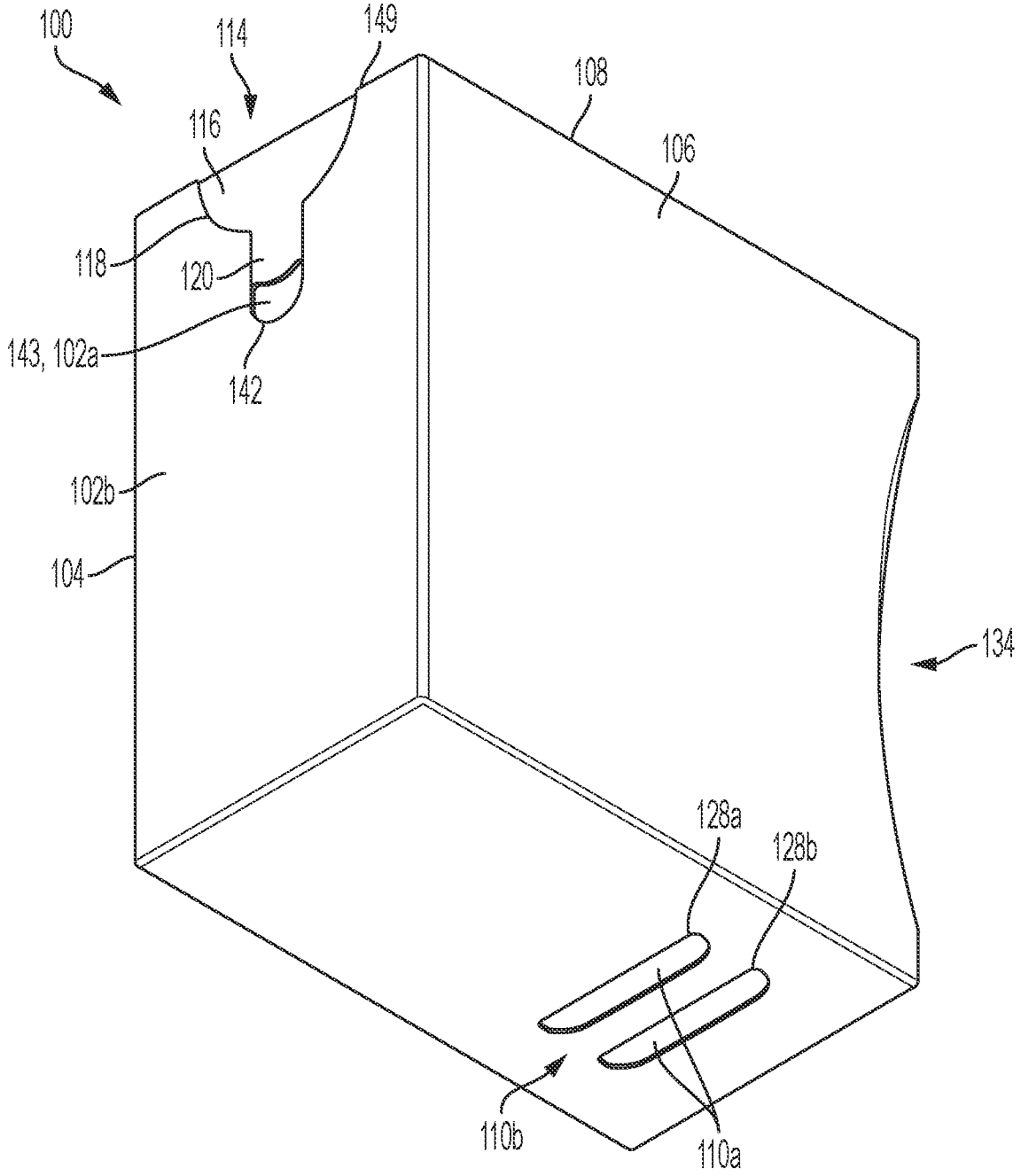
Figure 7:
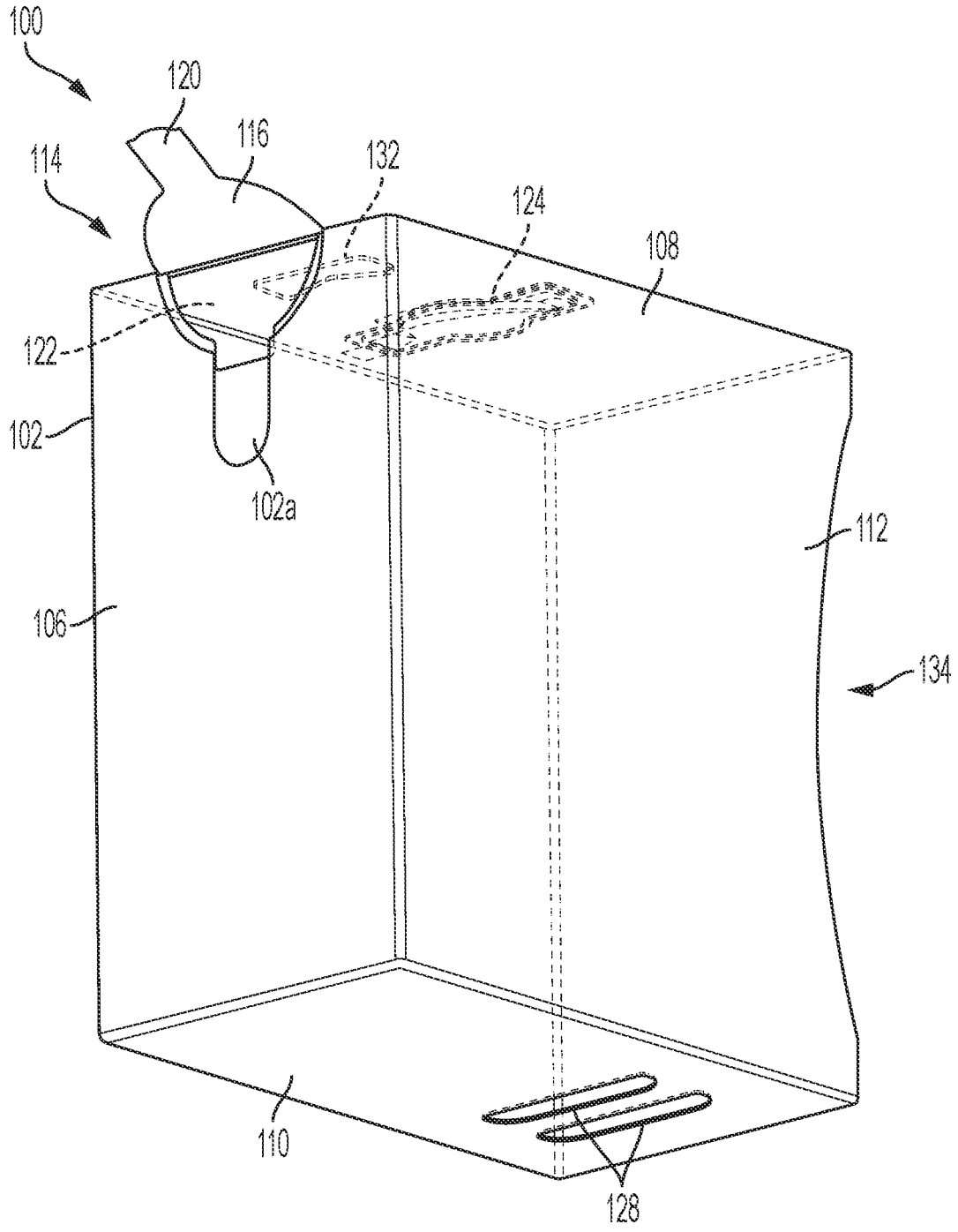
Figure 8:
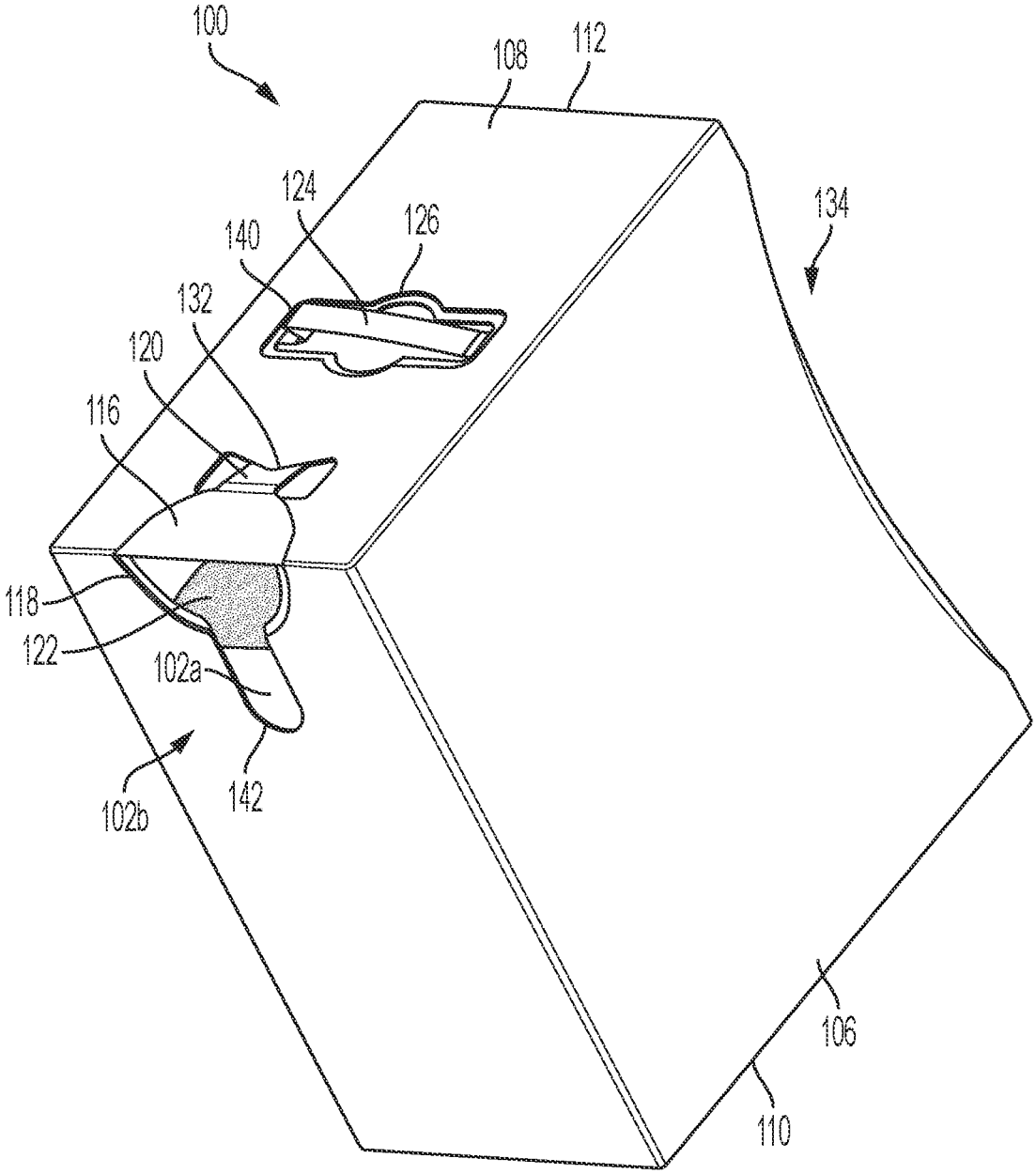
Figure 9:
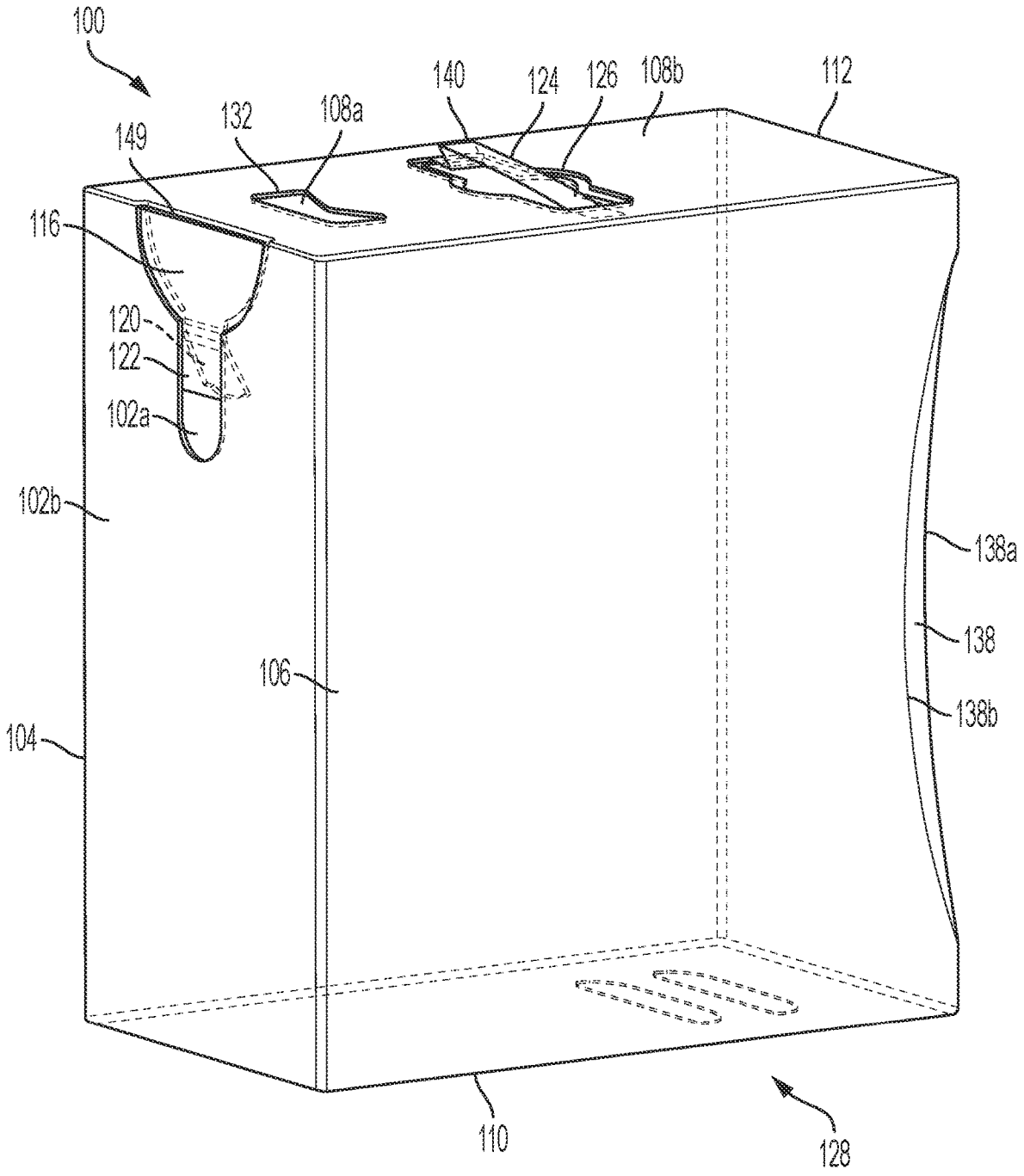
Figure 10A:
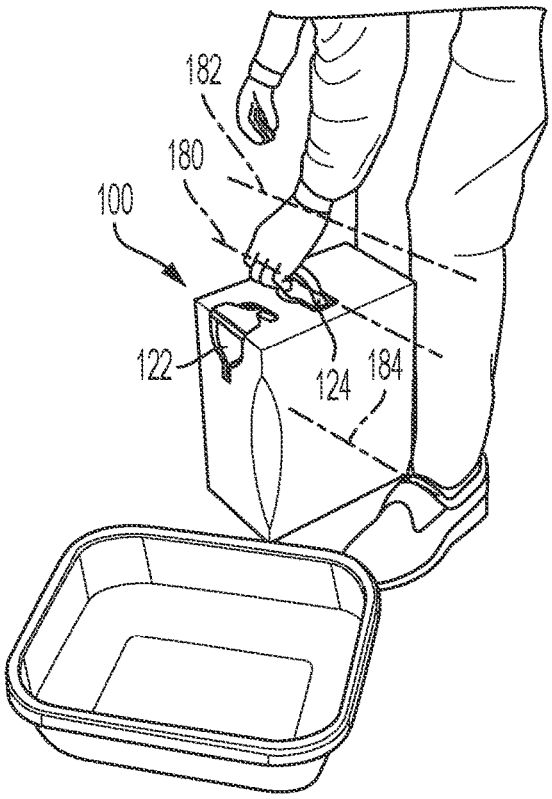
Figure 10B:
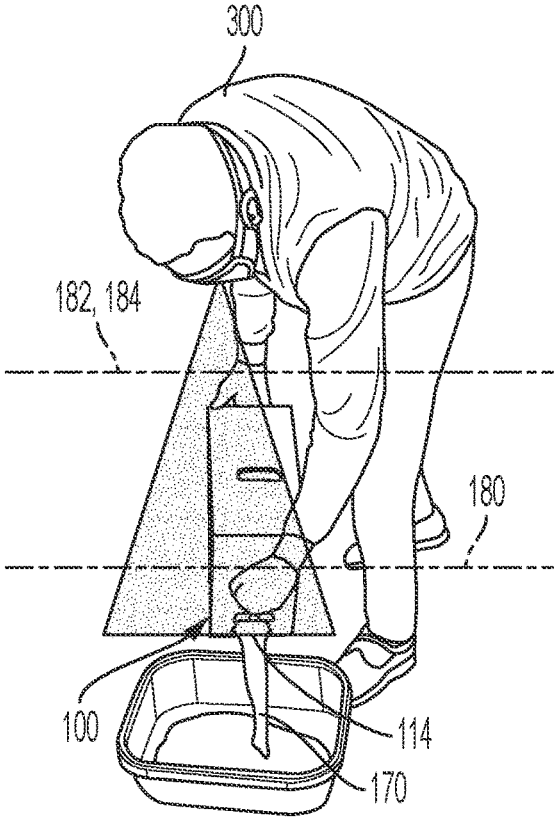

Having thus described the disclosure in general terms, reference will now be made to the accompanying drawings, which are not necessarily drawn to scale, and wherein:

FIG. 1 is a schematic top view of a container for holding and dispensing granular products according to one example embodiment of the present disclosure;

FIG. 2 is a schematic front view of a container for holding and dispensing granular products according to one example embodiment of the present disclosure;

FIG. 3 is a schematic side view of a container for holding and dispensing granular products according to one example embodiment of the present disclosure;

FIG. 4 is a schematic plan view of a unitary blank for forming a container as described herein according to one example embodiment of the present disclosure;

FIG. 5 is a schematic perspective front-top view of the container of FIGS. 1-3 according to one example embodiment of the present disclosure;

FIG. 5A is an enlarged view of a portion of the container of FIG. 5 according to one example embodiment of the present disclosure;

FIG. 6 is a schematic perspective front-bottom view of the container of FIGS. 1-3 according to one example embodiment of the present disclosure;

FIG. 7 is a schematic perspective front-bottom wire-frame view of the container of FIG. 5 according to one example embodiment of the present disclosure;

FIG. 8 is an enlarged schematic perspective front-top side view of the container of FIG. 5 according to one example embodiment of the present disclosure;

FIG. 9 is a schematic perspective front-top wire-frame view of the container of FIG. 5 according to one example embodiment of the present disclosure; and FIGS. 10A and 10B are pictorial representations of the container in a carrying mode and a dispensing mode of operation according to one example embodiment of the present disclosure.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, where multiples of the same components are described, the multiples may be referred to individually (e.g., ##a, ##b, ##c, etc.) or collectively (##). FIGS. 1, 2, and 3 generally depict top, front, and side views of a container 100 in an assembled configuration, where the container 100 has a three-dimensional shape enclosing an interior space (150 in FIG. 5). The container 100 is typically formed from a precut, unitary blank 101 having fold lines that permit the folding, forming, filling and sealing of the containers 100 using automated machinery. For many such containers 100, additional structure may be integrated into the blank 101 to provide certain features, such as, for example, perforated lines for making portions of the finished container 100 removable or "openable" or die cut openings in the blank to provide clearance openings or other structure in the finished container. The use of a unitary blank 101 is desirable to simplify assembly of the container and reduce material and assembly costs; however, in some embodiments, additional blanks and/or other assembly means may be utilized.

FIGS. 5, 5A 6, 7, 8, and 9 are various perspective type views of the container 100 from different angles so as to depict certain features of the container 100 in greater detail. Specifically, FIG. 5 is a front-top view of the container 100 illustrating the opening structure 114 in an unopened configuration, the receptacle 132, and the handle assembly 124 (shown enlarged in FIG. 5A). FIG. 6 is a front-bottom view of the container 100 illustrating the opening structure 114 in the unopened configuration and the hand grip structure 128. FIG. 7 is a front-bottom view of the container 100 illustrating the opening structure 114 in an open configuration, the hand grip structure 128, and the indicia 134, FIG. 8 is a front-top side view of the container 100 in a pour orientation and illustrating the opening structure 114 in a fully opened configuration and engaged with the receptacle 132 and the handle assembly 124, and FIG. 9 is a front-top side view of the container 100 illustrating the opening structure 114 in a re-closed configuration, the receptacle 132, the handle assembly 124, the hand grip structure 128, and the indicia 134.

As shown in FIGS. 1-3, the container 100 is formed via a plurality of panels folded or otherwise oriented relative to and secured to one another to form a generally cube-like shape. The plurality of panels includes a front panel 102, a first side panel 104, a second side panel 106, a top panel 108, a bottom panel 110, and a back panel 112. The panels typically comprise two layers; a base layer and an exterior layer bonded together and in some cases separable to provide certain structure. Additional structural details of the various panels are described in greater detail with respect to FIG. 4 below. The container 100 further includes a handle assembly 124, a container opening structure 114, a hand grip 128, and indicia 134 (e.g., visual and/or physical) for providing a cue to a user of a pour configuration of the container 100.

As shown best in FIGS. 1, 5, and 5A, the handle assembly 124 extends through the top panel 108 and is oriented to extend at least partially across a width (W) of the top panel. The handle assembly 124 generally runs from an area proximate the first side panel 104 to an area proximate the second side panel 106 and is extendable upwardly through an opening 126 in the top panel 108. In some embodiments, the handle assembly 124 is a separately supplied assembly as a folded strap 140 attached to a blank 152 that is secured to an underside of the top panel 108 so that the handle strap 140 extends through the opening 126. Alternatively, the handle assembly could be provided as a strap 140 that is bonded to a base layer 108*a* of the top panel 108 (e.g., via attachment tabs) and is sized and shaped to allow a user to at least partially insert their hand through a space defined between the strap 140 and the top panel 108. The handle assembly 124 may be made of a material that is the same material as the container panels and may include folds or pleats that allow the length of the strap 140 to expand to accommodate the user's hand and to collapse down to be substantially flush with a top surface of the top panel 108. Additional configurations are contemplated and considered within the scope of the invention.

In some embodiments, the top panel 108 is made up of an inner top panel 108*a* and an outer top panel 108*b* that overlaps the inner top panel and is bonded thereto to at least partially secure the container blank 101 in an assembled configuration. In such an arrangement, the opening 126 may be formed in the outer top panel 108*b* (e.g., via die-cutting) to expose a portion of the inner top panel 108*a* to which strap attachment tabs may be bonded, or a second, slightly smaller opening 126*a* may be formed in the inner top panel 108*a* so as to secure the handle assembly blank 152 while allowing the strap 140 to pass therethrough. The openings 126, 126*a* as shown have generally elongate shapes with an enlarged or widened area centrally located along the length of the strap 140, which may be useful for accommodating the user's hand. However, the actual size and shape of the openings 126, 126*a* may vary to suit a particular application. The handle assembly 124 is typically made of the same material as the panels.

The opening structure 114 is disposed in an upper portion of the front panel 102 adjacent to the top panel 108 and comprises a door 116 defined by a line of weakness 118 (e.g., perforations or scoring) extending through the front panel 102 that is configured to be breakable when a gripping tab 120 coupled to the door 116 is moved from a first position to a second position thereby, providing access to the interior 150 of the container 100 via an opening 122 defined by the front panel. Generally, the line of weakness 118 comprises a perforated region formed in the front panel 102 that is intended to be openable by application of a suitable force (e.g., the pull of the tab or pressing a thumb or finger against the perforated region). The perforated region forms the door 116 and is designed to remain connected to the container 100 by, for example, being hingedly coupled to the top panel 108 so that the door 116 is not detached from the container 100.

In some embodiments, the opening 122 extends through both an inner front panel 102*a* and an outer front panel 102*b*, while the gripping tab 120 that extends from the door 116 is only cut through the outer front panel 102*b*, which provides a wall (inner front panel 102*a*) behind which the gripping tab 120 may be tucked to lock the opening structure 114 in a closed configuration. See FIG. 9. In some embodiments, the cut-out 142 for the gripping tab 120 may be slightly larger than the gripping tab 120 so as to provide a recess thereabout to aid in gripping the gripping tab 120 and/or providing a visual cue as to where the opening structure 114 is located. For example, in some implementations, the cut-out 142 has a length extending beyond the length of the griping tab 120 thereby defining an opening between the gripping tab 120 and the leading edge of the cut-out 142, thereby exposing the inner front panel 102*a* (also zone 143 of the inner front panel 102*a* as described with respect to FIG. 4 below). See FIG. 7. In the embodiments shown, the door 116 and opening 122 have a generally semi-circular shape with the gripping tab 120 being a slightly elongated structured extending downwardly from the door 116. However, the size, shape and placement of the opening structure 114 may vary to suit a particular application, for example, overall container size, nature of the product, etc. As described in greater detail below, the door 116 may be foldable between a position covering the pouring opening 122 (closed) and a position overlying the top panel 108 of the container 100 (open), where the gripping tab 120 cooperates with a receptacle 132 to hold the door 116 open. See FIG. 8. Entry to the container 100 is gained by peeling back the door 116 via the gripping tab 120.

As shown best in FIG. 1 and FIG. 8, the container 100 includes a flap or similar structure that defines a receptacle 132 in the top panel 108 of the container 100. The receptacle 132 may be formed by cutting an opening in the top panel 108. For example, a portion of an outer top panel 108*b* may be removed (e.g., via die cutting) exposing an inner top panel 108*a* such that at least a portion of the receptacle is defined by the space between the inner and outer top panels 108*a*, 108*b*. Alternatively, just an exterior layer of the top panel 108 may be removed exposing a base layer of the top panel 108, such that the receptacle 132 is defined by the space between the exterior and base layers. In the embodiment shown, the receptacle is located proximate the front panel 102 and is configured (e.g., sized and shaped) to receive and removably secure at least a portion of the gripping tab 120. With the door 116 hingedly coupled to the top panel 108, this arrangement holds the door 116 out of the way of the opening so as to not interfere with dispensing the product. See FIG. 8.

In certain embodiments, the container 100 includes indicia 134, either physical and/or visual, that allows a user to readily recognize (e.g., by sight or feel) a pouring configuration of the container 100. As shown in the figures, the indicia 134 comprises a curved profile fold or corner indent that may be formed by a wall 138 that is apportioned from a portion of the second side panel 106 and the back panel 112 and is defined by opposing, mirror image, symmetrical, arcuate crease lines 138*a*, 138*b*. See FIG. 9. The corner indent 134 extends a substantial length of the container 100, however, the exact size, shape, and type of the indicia may vary to suit a particular application.

The container 100 further comprises a hand grip structure 128 configured to assist a user in handling the container 100, especially during dispensing of the product therein. The hand grip structure 128 is best shown in FIGS. 6 and 7. As shown, the hand grip structure 128 includes a plurality of slots 128*a*, 128*b* disposed in the bottom panel 110 proximate the back panel 112. Two slots are shown; however, additional slots may be included to suit a particular application. The two slots 128*a*, 128*b* are spaced apart and oriented substantially parallel to one another, the back panel 112, and the handle assembly 124. The slots 128*a*, 128*b*, 128"*n*" may be sized and shaped to accommodate different finger sizes and hand/finger lengths of a user. In one embodiment, the slots are generally elongate in shape with rounded ends and are cut from an outer bottom panel 110*b*, thereby exposing the inner bottom panel 110*a* and providing an opening for the user to grip. Alternatively, the slots can be cut from the external layer of the bottom panel 110 exposing the base layer of the bottom panel 110; however, the grip depth of the slots is reduced relative to an embodiment of the container 100 with inner and outer bottom panels 110*a*, 110*b*. The actual size and shape of the slots may vary to suit a particular application, for example, size of container, typical hand sizes of users, weight and nature of the product, etc. In other embodiments, the slot may be replaced or augmented by a plurality of aligned, roughly circular openings, a roughened surface, or a raised structure (e.g., raised ink).

FIG. 4 depicts a plan view of a blank 101 for forming the container 100. The blank 101 has a first surface 101*a* defined by the exterior layer as shown and a second opposing surface (101*b* not shown) defined by the base layer. More specifically, the blank 101 forming the container 100 has two layers; a base layer (i.e., second surface 101*b*) that faces the interior of the container 100 and defines the inner walls of the container 100 and an exterior layer (i.e., first surface 101*a*) disposed on top of the base layer and facing the exterior of the container 100. The exterior layer may have a semi-glossy coating to enhance the appearance of the container 100 and/or may have indicia printed thereon to identify the contents of the container 100 or the brand of the contents.

The blank 101 includes a plurality of panels, such as the front panel 104, the back panel 106, a first side panel 108, a second side panel 106, and the top and bottom panels 108, 110 as disclosed above. As shown in FIG. 4, each panel has first and second lateral sides (a), (b) and first and second longitudinal ends (c), (d) defining generally rectangular shapes; however, other shapes are contemplated and considered within the scope of the invention. The specific arrangement of the panels is described below.

The front panel 102 is made up of two panels; an inner front panel 102*a* having first and second lateral sides (a), (b) and first and second longitudinal ends (c), (d) and an outer front panel 102*b* having first and second lateral sides and first and second longitudinal ends. When the container 100 is in its assembled/folded configuration, the outer front panel 102*b* substantially to completely overlaps the inner front panel 102*a* and may be secured thereto via an adhesive 144 disposed on a substantial portion of the first surface of the inner front panel 102*a*. The first side panel 104 extends from the first lateral side of the inner front panel 102*a* and also has first and second lateral sides and first and second longitudinal ends. The back panel 112 extends from the first lateral side of the first side panel 104 and also has first and second lateral sides and first and second longitudinal ends. The second side panel 106 extends from the first lateral side of the of the back panel 112 and like the other panels has first and second lateral sides and first and second longitudinal ends. The outer front panel 102*b* extends from the first lateral side of the second side panel via its second lateral side.

The container blank 101 further includes the top and bottom panels 108, 110, which are also made up of inner and outer top panels 108*a*, 108*b* and inner and outer bottom panels 110*a*, 110*b*, respectively. The inner top panel 108*a* extends from the first longitudinal end (c) of the first side panel 104 and the outer top panel 108*b* extends from the first longitudinal end (c) of the second side panel 106, wherein the outer top panel 108*b* is configured to substantially to completely overlap the inner top panel 108*a* when the container is assembled. The outer top panel 108*b* may be secured to the inner top panel 108*a* via the adhesive 144 disposed on the first surface 101*a* of the inner top panel 108*a* as shown, for example, in FIG. 4. However, the exact shape, size and location of the "glue lines" (i.e., adhesive) will vary to suit a particular application and the particular assembly equipment used. Generally, enough adhesive should be used to securely join the panels so that they function for their intended purpose. In various implementations the overlapping panels may be secured to one other via any other means as known to a person of skill in the art. Similarly, the inner bottom panel 110*a* extends from the second longitudinal end (d) of the first side panel 104 and the outer bottom panel 110*b* extends from the second longitudinal end (d) of the second side panel 106, wherein the outer bottom panel 110*b* is configured to substantially to completely overlap the inner bottom panel 110*a* when the container is assembled and secured to the inner bottom panel 110*a* via the adhesive 144 disposed on the first surface 101*a* of the inner bottom panel 110*a*.

In various implementations, the back panel 112 and the outer front panel 102*b* include first front and back flaps 103*a*, 113*a* and second front and back flaps 103*b*, 113*b* extending from the first longitudinal ends of the outer front panel 102*b* and the back panel 112 and the second longitudinal ends of the outer front panel 102*b* and back panel 112, respectively. The flaps 103*a*, 103*b*, 113*a*, 113*b* are hingedly coupled to their respective panels and are configured to be folded inwardly about 90 degrees so as to be positioned under or over (as the case may be) their respective inner top panel 108*a* and inner bottom panel 110*a* in the assembled configuration. In some implementations, any one of the flaps may include an adhesive disposed thereon to further secure the container in the assembled configuration. The flaps 103*a*, 103*b*, 113*a*, 113*b* are generally rectangular in shape and include recesses or cut-outs 148 that assist in the assembling of the container (e.g., providing clearance) and function to, at least, block any gaps that may be defined between any of the panels.

The inner front panel 102*a* includes an opening 122 die cut therethrough at the first longitudinal end thereof to provide the outlet for dispensing the contents of the container. The opening has a generally semi-circular shape with a recess 123 disposed at the bottom thereof to provide means for receiving and securing the gripping tab 120 in the closed configuration. The inner front panel 102*a* has a reduced second longitudinal end via the angled cut-out 148. An optional tab or flap 113*c* may extend from the second longitudinal end that is folded inwardly at assembly to aid in assembly and closing a gap between the panels. The first surface 101*a* (i.e., exterior layer) of the inner front panel may be substantially covered with the adhesive 144 for securing the inner front panel 102*a* to the outer front panel 102*b* and the tab 113*c* to the second surface (i.e., base layer) of the inner bottom panel 110*a*.

The outer front panel 102*b* includes a corresponding perforated section (door 116 and gripping tab 120) defined by the perforation 118 that allows the door 116 to be moved between an open and a closed configuration. The outer front panel 102*b* further includes an opening 142 extending therethrough that that assists a user in grasping the gipping tab 120 and is backed by a portion of the inner front panel 102*a*. The portion is an adhesive free zone 143 behind which the gripping tab 120 can be tucked to re-close the container 100 as described above.

The inner top panel 108*a* may include an opening 126*a* therethrough to provide for passage of at least a portion (e.g., strap 140 as described above) of the handle assembly 124. As also described above, the handle assembly 124 includes a base 152 that may be attached to the underside (second surface 102*b*) of the inner top panel 108*a* as, for example, a later operation and/or third party task. The outer top panel 108*b* includes a larger opening 126 extending therethrough that corresponds to opening 126*a* and a smaller opening 133 corresponding to an area proximate the front panel when the container 100 is assembled to define the receptacle 132 for receiving the gipping tab 120 as described above. The outer top panel 108*b* further includes a recess 149 cut into an end of the panel 108*b* that corresponds to the front panel when the container is assembled. The recess 149 provides for clearance for the door 116 to be fully opened and lie flat against the top panel 108 when opened. Additionally, the first surface of the inner top panel 108 includes adhesive 144 disposed thereon at one or more places as needed to secure the second side of the outer top panel 108*b* thereto. No adhesive is disposed in the area corresponding to the receptacle 132.

The outer bottom panel 110*b* includes the openings 128*a*, 128*b* for the hand grip feature as described above. As shown, the openings 128 are disposed proximate an area of the outer bottom panel 110*b* that corresponds to the back panel 112 when the container is assembled. The first surface of the inner bottom panel 110*a* includes one or more areas covered with the adhesive 144 as needed to secure the second surface of the outer bottom panel 110*b* thereto. No adhesive is disposed in the area corresponding to the hand grip openings 128.

As further shown in FIG. 4, a portion of the first lateral side of the back panel and a portion of the second lateral side of the second side panel have corresponding curved profile fold lines 138 that are disposed mirror image about an axis defined by the first lateral side of the back panel or second lateral side of the second side panel. When all of the panels are folded in the assembled configuration, the curved profile lines 138 define the indicia 134 described above.

The various panels described herein are interconnected via boundaries between the panels, which may be defined by a plurality of predetermined fold lines 146, which allow the individual panels to be "hingedly" coupled to one another to allow folding in one or both directions. Some or all of the fold lines 146 may be formed in the blank 101 by stamping, indenting, pre-creasing, or scoring the perimeters (e.g., longitudinal ends and lateral sides) corresponding to the individual sections of the blank 101 and as shown as heavy dashed lines in FIG. 4. Further still, some or all of the fold lines 146 may be provided with a series of perforations to assist with folding of the blank 101 along the predetermined fold lines. Additionally, some of the panels may include additional structure 148 (e.g., cut-outs, recesses, chamfers, rounded corners, etc.) that assist with the folding of the panels relative to one another.

The adhesive 144 used to secure certain panels in overlapping contact may include double sided tape or glue and may be pressure sensitive, heat sensitive, UV cured, or as otherwise known in the industry. Other exemplary types of adhesives that may be used include vinyl acetates, hot melts, and dextrins, such as those available from Henkel AG & Co. The actual dimensions of the various panels will vary to suit a particular application, for example, number, size, and types of components to be held within the container 100.

FIGS. 10A and 10B depict the ergonomic advantages of a container 100 as described herein. FIG. 10A depicts a user 300 picking up and carrying the container 100. As shown, the perpendicular axis 180 of the handle is parallel with the perpendicular axis 182 of the user 300 and the perpendicular axis 184 of the hand grip, which eliminates or reduces any torsional loading on the user's wrist when lifting and carrying the container. FIG. 10B, which depicts a user 300 using the container 100 to dispense a product 170 by lifting the container 100 by the handle assembly 124 and using the parallel hand grip to rotate the container upwardly to dispense the product 170 through the opening 122 without straining the user's wrists.

Generally, when the blank is assembled into its finished configuration, the assembly may involve folding the blank. Unless otherwise noted, each of the folds employed in forming the blank into its finished configuration involves moving a first surface of the referenced panel(s) toward one another or may involve moving the second surface of the referenced panel(s) toward one another. Folds that are conducted in a differing direction from other folds are referenced as being "opposing."

Furthermore, the blank should be understood as a substantially two-dimensional structure configured to be manipulated into a three-dimensional container. The blank may comprise one or more layers of one or more materials suitable to provide structure to the blank such that it may form a container as described herein. The blank may define various sizes and shapes and, accordingly, it should be understood that the illustrated blank is provided for example purposes only.

Having described the individual panels of the blank in the illustrated implementations, it should be appreciated that additional panels may be added to the blank without deviating from the scope of this disclosure. However, it should also be appreciated that in some implementations, advantages may stem from the blank exclusively defined by the set of illustrated panels without more.

Although directional terms such as top, bottom, front, back, etc. have been employed herein, it should be understood that these terms have been provided for explanatory purposes only. In this regard, the blank and container disclosed herein may be employed in other configurations and orientations beyond those described above.

In addition, use of the words "about" and "substantially" herein are understood to mean that values that are listed as "about" a certain value or "substantially" a certain value may vary by an industry recognized tolerance level for the specified value. When an industry recognized tolerance is unavailable, it is understood that such terminology may indicate that an acceptable value may be vary ±3%, ±2%, or ±1% from the specifically listed value.

Many modifications and other implementations of the disclosure will come to mind to one skilled in the art to which this disclosure pertains having the benefit of the teachings presented in the foregoing descriptions and the associated figures. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

What is claimed is:

1. A container for holding and dispensing a granular product comprising:

a plurality of panels that at least partially define an interior of the container when in an assembled configuration, the plurality of panels comprising front panels, a back panel, a first side panel, a second side panel, top panels, and bottom panels;

a handle extending from the top panels and oriented to extend across a width of the top panels from proximate the first side panel to proximate the second side panel;

a hand grip disposed in an exterior layer of the bottom panels and disposed proximate the back panel, the hand grip oriented substantially parallel to the handle, wherein the front panels comprise:

an outer front panel comprising first and second lateral sides and first second longitudinal ends and a container opening structure disposed therein proximate the first longitudinal end, the container opening structure comprising a door defined by a line of weakness extending through the outer front panel and configured to be breakable when a gripping tab coupled to the door is moved from a first position to a second position; and an inner front panel comprising first and second lateral sides, and a first longitudinal end defining a first opening, wherein the outer front panel is secured to the inner front panel in the assembled configuration; and a locking structure defined by a recess formed between the outer front panel and the inner front panel proximate the first opening and defined by an area where the outer front panel is not secured to the inner front panel, wherein the recess is configured to receive at least a portion of the gripping tab therein in the first position, wherein the top panels comprise an inner top panel and an outer top panel defining a receptacle therebetween configured to receive and removably secure at least a portion of the gripping tab in the second position, the outer top panel defining a second opening therein disposed proximate the front panels and providing access to the receptacle, thereby providing access to the interior of the container via the first opening defined by the inner front panel with the gripper tab in the second position.

2. The container of claim 1, wherein the door is hingedly coupled to the container.

3. The container of claim 1 further comprising indicia for providing a cue to a user of the pour configuration of the container.

4. The container of claim 3, wherein the indicia comprise a curved profile fold disposed between the back panel and the second side panel, opposite the container opening structure.

5. The container of claim 1, wherein the bottom panels comprise an inner bottom panel and an outer bottom panel and the hand grip comprises at least two parallel slots extending through the outer bottom panel and spaced to provide multiple grip sizes, the two parallel slots are oriented parallel with the handle and container opening structure.

6. The container of claim 1, wherein the handle is bonded to the inner top panel and is configured to extend through an opening in the outer top panel for gripping and to be collapsible so as to sit approximately flush with an exterior layer of the upper top panel when not in use.

7. The container of claim 1, wherein the plurality of panels and handle comprise a recyclable material, so as to be completely recyclable as a unit.

8. The container of claim 1, wherein the plurality of panels comprises a blank having a first surface and a second surface, the blank comprising:

the inner front panel and the outer front panel;

the first side panel extending from the first lateral side of the inner front panel, the first side panel comprising first and second lateral sides and first and second longitudinal ends;

the back panel extending from the first lateral side of the first side panel, the back panel comprising first and second lateral sides and first and second longitudinal ends;

the second side panel extending from the first lateral side of the of the back panel, the second side panel comprising first and second lateral sides and first and second longitudinal ends, wherein the outer front panel extends from the first lateral side of the second side panel via the second lateral side of the outer front panel;

the inner top panel extending from the first longitudinal end of the first side panel and the outer top panel extending from the first longitudinal end of the second side panel, wherein the outer top panel is configured to overlap the inner top panel in the assembled configuration; and the bottom panels comprising an inner bottom panel extending from a second longitudinal end of the first side panel and an outer bottom panel extending from a second longitudinal end of the second side panel, wherein the outer bottom panel is configured to overlap the inner bottom panel in the assembled configuration, wherein the overlapping panels are secured in place via an adhesive in the assembled configuration.

9. The container of claim 8, wherein the blank further comprises a first back flap extending from the first longitudinal end of the back panel and a second back flap extending from the second longitudinal end of the back panel, wherein the first and second back flaps are folded under their respective inner top and inner bottom panels in the assembled configuration.

10. The container of claim 8, wherein the blank further comprises a first front flap extending from the first longitudinal end of the outer front panel and a second front flap extending from the second longitudinal end of the outer front panel, wherein the first and second front flaps are folded under their respective inner top and inner bottom panels in the assembled configuration.

11. The container of claim 8, wherein the blank further comprises a reinforcement panel coupled to the second surface of the inner top panel at a location generally corresponding to a location of the handle.

12. The container of claim 8, wherein the inner front panel of the blank further comprises a tab extending from a second longitudinal end thereof, the tab configured to be folded under the inner bottom panel in the assembled configuration.

13. The container of claim 8, wherein a portion of the first lateral side of the back panel and a portion of the second lateral side of the second side panel comprise corresponding curved profile fold lines.

14. The container of claim 8, wherein, in the assembled configuration, the first surface of the inner front panel is adhered to the second surface of the outer front panel, the first surface of the inner top panel is adhered to the second surface of the outer top panel, and the first surface of the inner bottom panel is adhered to the second surface of the outer bottom panel.

15. The container of claim 8, wherein the panels are hingedly coupled to one another to allow the panels to fold relative to one another in one or both directions via fold lines created by stamping, indenting, pre-creasing, a series of perforations, or any combination thereof.

16. The container of claim 15, wherein the panels are folded at approximately 90 degrees relative to adjacent panels in the assembled configuration.

17. The container of claim 8, wherein the blank comprises paperboard, corrugated board, chipboard, fiberboard, thermoplastic, paper film laminations, or combinations thereof.

18. The container of claim 8, wherein the first surface is configured to comprise indicia comprising at least one of an ornamental design, identifying information, or a date code.

19. The container of claim 8, wherein the opening in the outer top panel is die cut through the outer top panel.

20. The container of claim 8, wherein the outer bottom panel comprises at least two parallel slots die cut therethrough proximate a second lateral side of the outer bottom panel to define the hand grip.

21. The container of claim 8, wherein an elongate opening is die cut through the outer top panel in a central location thereof and oriented across a width of the top panel, the opening configured to expose the first surface of the inner top panel and provide clearance for the handle, the handle bonded to the first surface of the inner top panel.

22. A container for holding and dispensing a granular product comprising:

a plurality of panels that at least partially define an interior of the container when in an assembled configuration, the plurality of panels comprising front panels, a back panel, a first side panel, a second side panel, top panels, and bottom panels;

a handle extending from the top panels and oriented to extend across a width of the top panels from proximate the first side panel to proximate the second side panel;

a container opening structure disposed in the front panels and comprising a door defined by a line of weakness extending therethrough and configured to be breakable when a gripping tab coupled to the door is moved from a first position to a second position thereby providing access to an interior of the container via an opening defined by the front panels, wherein the bottom panels comprise:

an inner bottom panel extending from a second longitudinal end of the first side panel and extending along an entire length thereof; and an outer bottom panel extending from a second longitudinal end of the second side panel and extending along an entire length thereof, wherein the outer bottom panel is configured to overlap the inner bottom panel in the assembled configuration; and a hand grip disposed in an exterior layer of the outer bottom panel and at least partially exposing a base layer of the outer bottom panel, the hand grip disposed proximate the back panel and oriented substantially parallel with the handle and the container opening structure.

* * * * *